US005802885A

United States Patent [19]

Kim

[11] Patent Number: 5,802,885

[45] Date of Patent: Sep. 8, 1998

[54] BALANCING DEVICE FOR DRUM WASHING MACHINE

[75] Inventor: Jin-Soo Kim, Suwon, Rep. of Korea

[73] Assignee: Samsung Electronics Co., Ltd., Suwon, Rep. of Korea

[21] Appl. No.: 861,568

[22] Filed: May 22, 1997

[30] Foreign Application Priority Data

May 30, 1996 [KR] Rep. of Korea ..... 1996-13848 U
May 30, 1996 [KR] Rep. of Korea ..... 1996-13849 U
May 30, 1996 [KR] Rep. of Korea ..... 1996-13853 U

[51] Int. Cl.[6] ..... D06F 37/22

[52] U.S. Cl. ..... 68/23.2; 74/573 R

[58] Field of Search ..... 68/23.2; 210/144, 210/363, 364; 74/573 F, 573 R

[56] References Cited

U.S. PATENT DOCUMENTS 2,836,046 5/1958 Smith ..... 210/363 X
2,984,094 5/1961 Belaieff ..... 68/23.2
3,800,622 4/1974 Stelwagen et al. ..... 210/363 X
5,115,651 5/1992 Nukaga et al. ..... 210/363 X
5,460,017 10/1995 Taylor ..... 68/23.2

*Primary Examiner*—Philip R. Coe
*Attorney, Agent, or Firm*—Burns, Doane, Swecker & Mathis, L.L.P.

[57] ABSTRACT

A drum clothes washing machine is formed by a cylindrical side panel and front and rear end panels. The cylindrical side panel defines a longitudinal center axis about which it rotates. Plates are connected to respective ones of the front and rear panels to form an interface therewith. Each panel, together with its respective plate, forms radially spaced coaxial races in which balancer balls are movably disposed. The interfaces are spaced longitudinally from the centers of the balls disposed in the respective races.

8 Claims, 5 Drawing Sheets

BALANCING DEVICE FOR DRUM WASHING MACHINE

BACKGROUND OF THE INVENTION (1) Field of the Invention

The present invention generally relates to a balancing device for a drum washing machine. More particularly, it relates to a balancing device for a drum washing machine realized as races provided to the washing machine's spin basket, and a plurality of balls seated in the respective races.

(2) Description of the Prior Art

A conventional drum washing machine is an electronic appliance that washes clothes utilizing the suds produced by the rotation of its drum-type spin basket. With the conventional drum washing machine, washing, rinsing and hydro-extracting tasks are automatically carried out according to a prescribed program recorded in the drum washing machine's microcomputer. After the washing and rinsing steps are completed, excess water is removed from the clothes by centrifugal force created by the spin basket rotating at high speeds during the hydro-extracting process. Because abnormal vibrations and noise may be produced by the uneven distribution of the clothes in the spin basket during the hydro-extracting process, a balancing device is essential for the smooth operation of a drum washing machine.

FIG. 5 is a perspective view of a conventional drum washing machine equipped with a balancing device.

Referring to FIG. 5, the drum washing machine includes a housing 1, a tub 2 suspended by suspension springs 4*a* and shock-absorbing members 4*b* in the housing 1, and a spin basket 3 rotatably installed in the tub 2. The spin basket 3 is rotated by an electric motor 5, which is installed on the bottom of the housing 1, by means of a drive belt (not illustrated). The spin basket 3 has a plurality of small holes 3*a* uniformly formed through its surface, and a plurality of inward-protruding lifters 3*b* spaced a predetermined distance away from each other. Water, removed from clothes in the spin basket 3 by centrifugal force, drains into the tub 2 through the small holes 7, and the lifters 8 agitate the laundry and water created during the rotation of the spin basket 3, to thereby create suds which clean the clothes.

In order to prevent the generation of vibrations during the washing/hydro-extracting process, counterweights, each of predetermined weight, are attached to the tub 2. An 11.4 kg front counterweight 6*a* is provided to the front of the tub 2, and a 12.2 kg upper counterweight 6*b* is mounted on the top surface of the tub 2. These counterweights 6*a* and 6*b* are made from cast iron and are joined to the tub 2 by bolts 7.

Such a conventional balancing device does not fundamentally prevent the vibrations created by unevenly distributed laundry in the washing machine, but rather only restrains the vibrations with the counterweights that are attached to the tub, and therefore has inferior balancing characteristics. Moreover, the conventional balancing device reduces the vibrations after they have already been transmitted to the tub, and so is incapable of controlling the imbalance in the initial stage of vibration creation.

SUMMARY OF THE INVENTION

The present invention relates to a balancing device for a drum washing machine that can obviate the above-described problems and disadvantages of the conventional art.

It is an objective of the present invention to provide a balancing device for a drum washing machine for dynamically counteracting an imbalance, which is created by laundry being unevenly distributed within the washing machine's spin basket during rotation, in the initial stage of vibration creation.

It is another objective of the present invention to provide a balancing device provided to the drum washing machine's spin basket that prevents the deformation of the washing machine's front and rear panels.

In order to obtain the aforementioned objectives of the present invention, there is disclosed a balancing device for a drum washing machine which includes: a rotatable spin basket comprised of a side panel connected to front and rear panels; races of annular shape provided to both the front and rear panels that are concentric with the spin basket and protrude to both sides of the respective front panel or rear panel; and a plurality of balls seated in the races.

Each of the races is formed of an inward groove formed on the front panel or rear panel, and an outward groove formed opposite the inward groove on the same panel. One groove is formed on the actual front or rear panel, while the other is formed on a plate member which is then joined to the panel. The depths of the respective outward and inward grooves are different from each other and different from the radius of the balls. At least two of the races are concentrically formed, and the races protruding to the outside of the front or rear panel are the same as the races protruding to the inside of the front or rear panel in number. The two concentric races are each constituted of the combination of the inward groove that is formed on the front or rear panel, and the outward groove that is formed on the plate member. The plate member is joined to the front or rear panel to lie opposite the inward grooves. One of the races has its inward groove deeper than its outward groove while the other has its outward groove deeper than its inward groove.

DETAILED DESCRIPTION OF THE PREFERRED EMBODIMENTS

The preferred embodiments of the present invention will now be described in detail with reference to the accompanying drawings.

Figure 1:
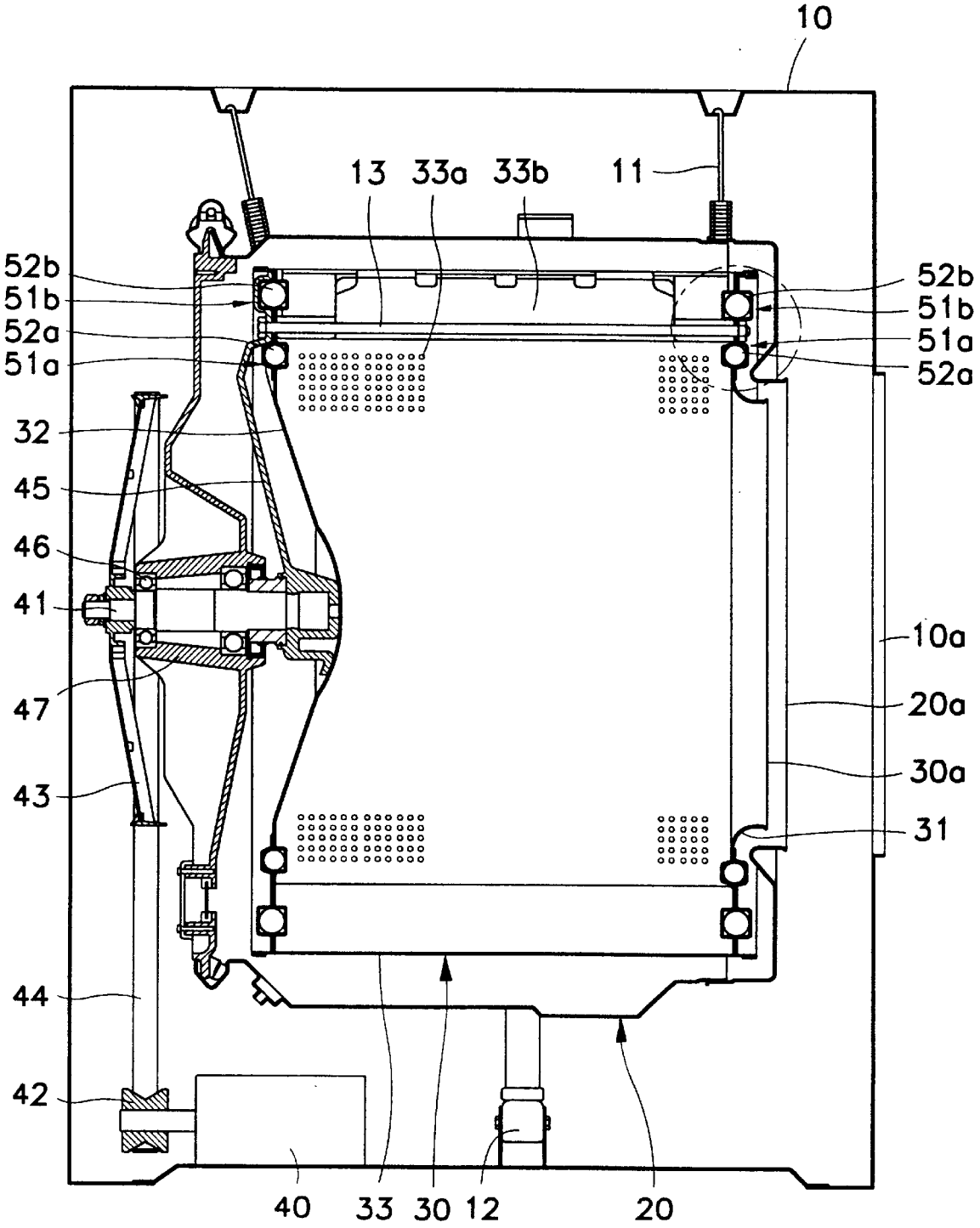
FIG. 1 is a sectional view of a drum washing machine with a balancing device in accordance with the present invention.

FIG. 1 is a sectional view showing the overall construction of a drum washing machine equipped with a balancing device in accordance with the present invention.

As shown in FIG. 1, the drum washing machine includes a housing 10, a tub 20 suspended in the housing 10, a spin basket 30 rotatably installed within the tub 20, and an electric motor 40 mounted below the tub 20 that rotates the spin basket 30. The tub 20 is suspended by four springs 11 arranged on four sides of the housing 10, and a pair of shock absorbing arms 12 are provided under the tub 20.

The tub 20 and spin basket 30 are installed parallel to the ground rather than upright, and openings 10*a*, 20*a* and 30*a* are respectively formed: on the front of the housing 10, on a predetermined spot of the tub 20 corresponding to the front of the housing 10, and on a corresponding spot of the spin basket 30, so that laundry can be put into or taken out of the spin basket 30 therethrough.

The spin basket 30, rotatably installed within the tub 20, is constructed of a cylindrically-shaped side panel 33, and front and rear panels 31 and 32 respectively joined to the front and back of the side panel 33. The spin basket 30 has a plurality of holes 33*a* that are uniformly formed in the side panel 33, and three lifters 33*b* that are formed on the side panel 33 protruding inward in the form of a "V", and are spaced 120° from each other. The lifters 33*b* raise and drop the laundry to agitate it during washing. The small holes 33*a* allow water to flow freely between the tub 20 and the spin basket 30, and let water, removed from laundry during the hydro-extracting process, drain into the tub 20.

The rotating force of the electric motor 40 is transmitted to the spin basket 30 through a shaft 41 which is connected to the rear panel 32. The shaft 41, horizontally supported, extends from the rear panel 32 to the rear of the tub 20. A first pulley 42 is connected to the electric motor 40, and a second pulley 43 is connected to the shaft 41. A belt 44 is positioned between the first and second pulleys 42 and 43, and a flange 45 is provided to the rear panel 32 connected with the shaft 41. A pair of bearings 46 are installed between the shaft 41 and the tub 20 so as to support the shaft 41. These bearings 46 are seated in a bearing housing 47.

The spin basket 30 has a pair of balancing devices each provided to the front and rear panels 31 and 32 in order to remove the vibrations and imbalances created during rotation. The balancing devices are realized as annular-shaped radially inner and outer races 51*a* and 51*b* that are concentrically formed on radially inner and outer parts of the front and rear panels 31 and 32, and a plurality of balls 52*a* and 52*b*(which serve as counterweights) that are respectively seated in the races 51*a* and 51*b*. The inner race 51*a* and the outer race 51*b* are bonded to each other by welding to form a seal. The races 51*a* and 51*b* contain an oil of a predetermined amount, thereby allowing the balls 52*a* and 52*b* to move freely therein.

The balancing device of the present invention will be more fully described as follows.

The races 51*a* and 51*b*, provided to the front panel 31 and rear panel 32, are formed symmetrically in order to prevent deformation of the front and rear panels 31 and 32 during the rotation of the spin basket 30. That is, the moment created by one balancing device is offset by that of the other balancing device, thus precluding the deformation of the front and rear panels 31 and 32. As described above, the races 51*a* and 51*b* are symmetrical in their installation to either panel, so the races 51*a* and 51*b* for the front panel 31 are now described by way of an example.

Figure 2:
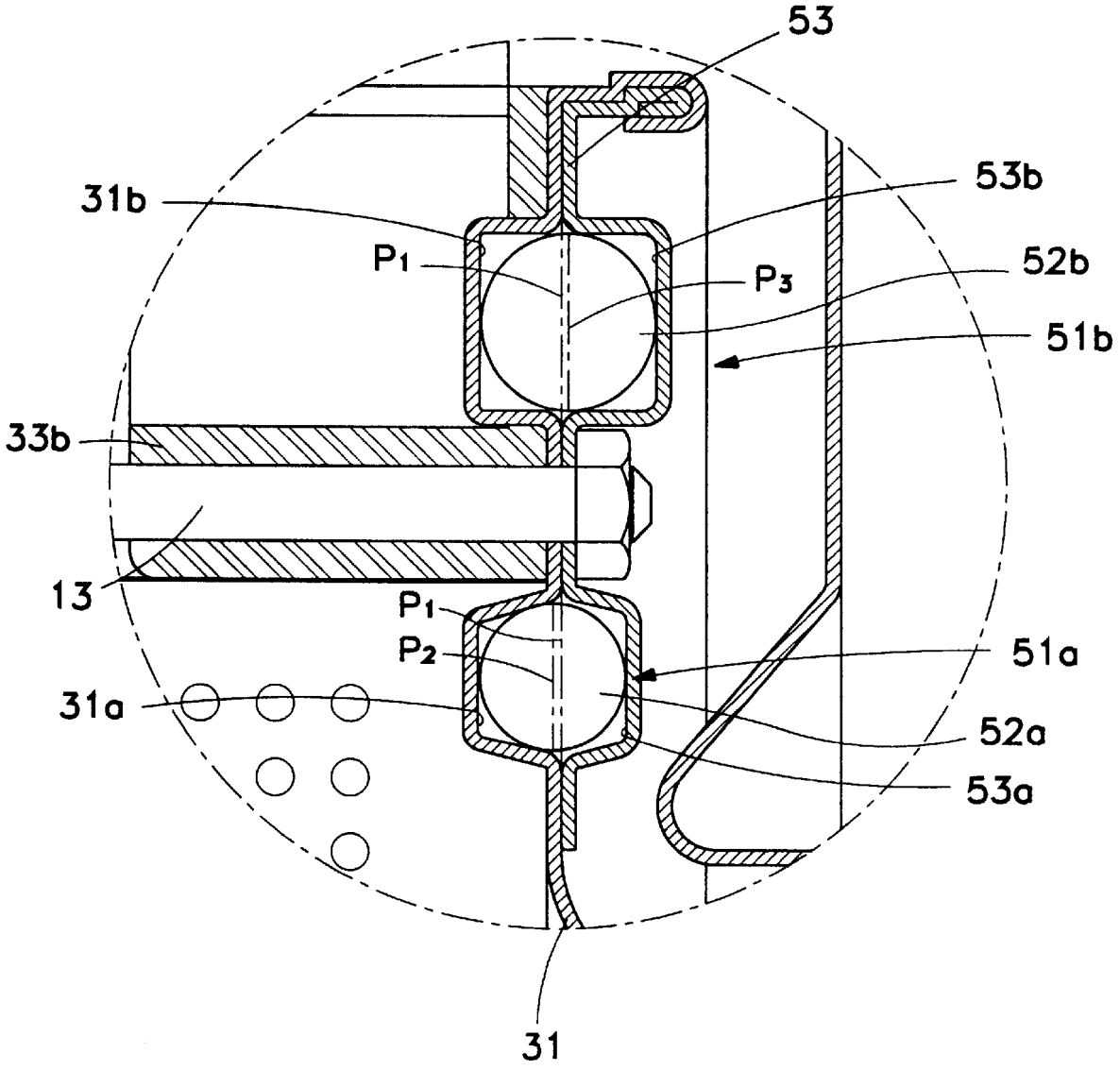
FIG. 2 is an enlarged view of a part of the balancing device of FIG. 1 in accordance with a first preferred embodiment of the present invention.

FIG. 2 is an enlarged view of a part of the balancing device of FIG. 1 in accordance with the first preferred embodiment of the present invention. The races 51*a* and 51*b* are formed by the combination of longitudinally inward grooves 31*a* and 31*b*, formed on the front panel 31, and longitudinally outward grooves 53*a* and 53*b*, formed on a plate member 53 that is coupled to the front panel 31.

The depth of each inward groove 31*a* and 31*b* is similar to that of the respective outward grooves 53*a* and 53*b*, so the races 51*a* and 51*b* protrude toward either side of the front panel 31 to a similar degree. The force moment created by the race 51*a* is reduced by that of the race 51*b*. With regard to the depths of the inward and outward grooves 31*a*, 31*b* and 53*a*, 53*b*, it is preferable that the joint (front interface) $P_1$ of the front panel 31 and the plate member 53 does not meet (intersect) the centers P2 and P3 of the respective balls 52*a* and 52*b* so that the moving balls 52*a* and 52*b* do not ride in the groove created by the joint P1. It is more preferable that the outward groove 53*b* of the outer race 51*b* is deeper than its inward groove 31*b*, while the inward groove 31*a* of the inner race 51*a* is deeper than its outward groove 53*a* so that the moment created by the inner race 51*a* is counterbalanced by the moment of the outer race 51*b*. However, the same effect can be expected if the inward groove 31*b* of the outer race 51*b* is deeper than its outward groove 53*b*, while the outward groove 53*a* of the inner race 51*a* is deeper than its inward groove 31*a*. The plate member 53 is securely joined to the front and rear panels 31 and 32 by the bolt 13, as shown in FIG. 1.

Figure 3:
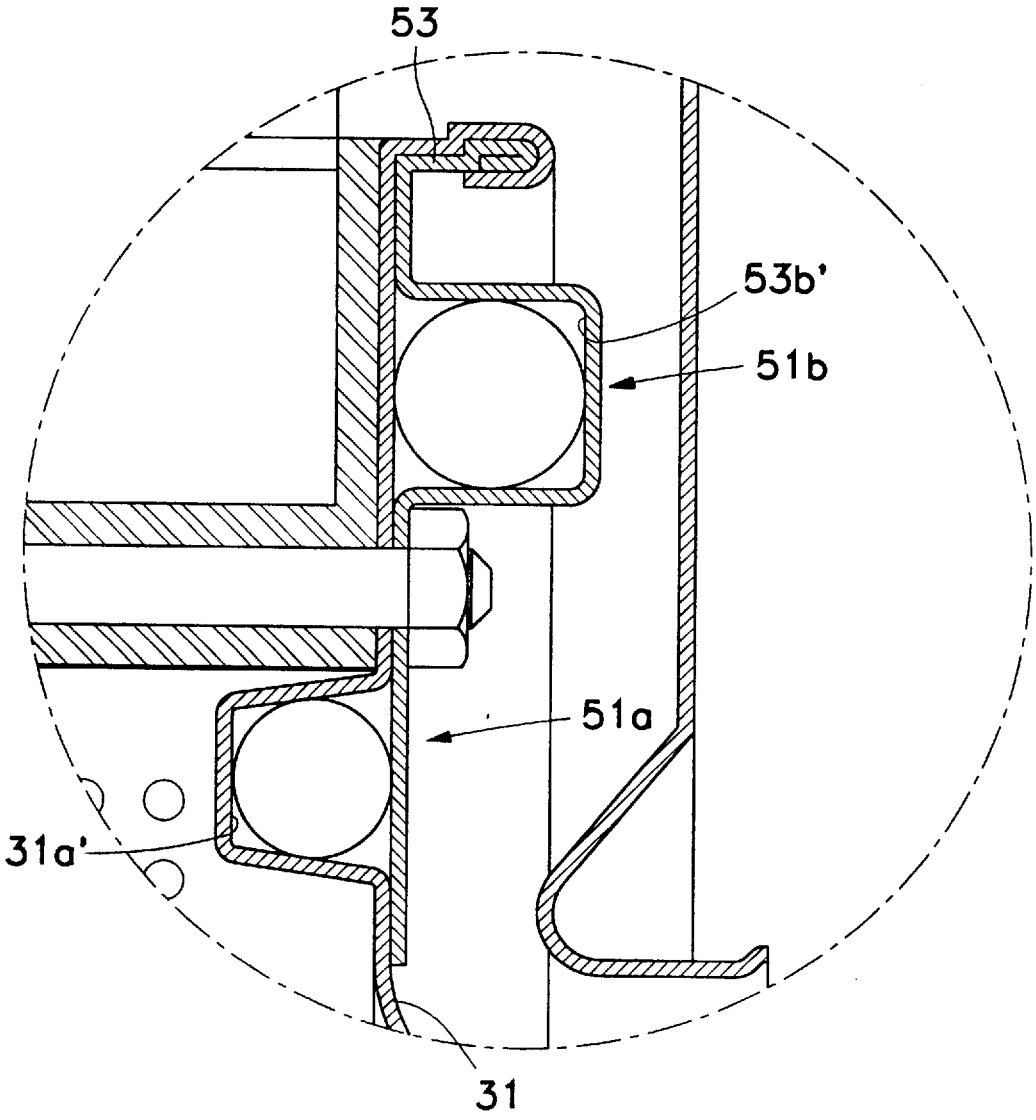
FIG. 3 is an enlarged view of a part of a balancing device for a drum washing machine in accordance with a second preferred embodiment of the present invention.

FIG. 3 is an enlarged view of a part of a balancing device for a drum washing machine in accordance with a second preferred embodiment of the present invention.

An inner race 151*a* is formed in a front panel 131 to protrude longitudinally away from a front plate 153, while an outer race 151*b* is formed in the plate 153 to protrude longitudinally away from the front panel 131 so that the moment produced by the inner race 151*a* is counterbalanced by that of the outer race 151*b*. That is, the outer race 151*b* is constituted of the combination of a flat portion of the front panel and an outward groove 153*b*' that protrudes outward on the plate member 153 which is joined to the front panel. The inner race 151*a* is constituted by the combination of an inward groove 131*a*', formed as protruding inward on the front panel, and the flat portion of the plate 153. Forming the two races 151*a*,151*b* on opposite sides of the joint or front interface formed between front panel 131 and the plate 153 serves to balance their respective moments. The construction of the races 151*a*,151*b* opposite to the above structure also assures the same effect.

Figure 4:
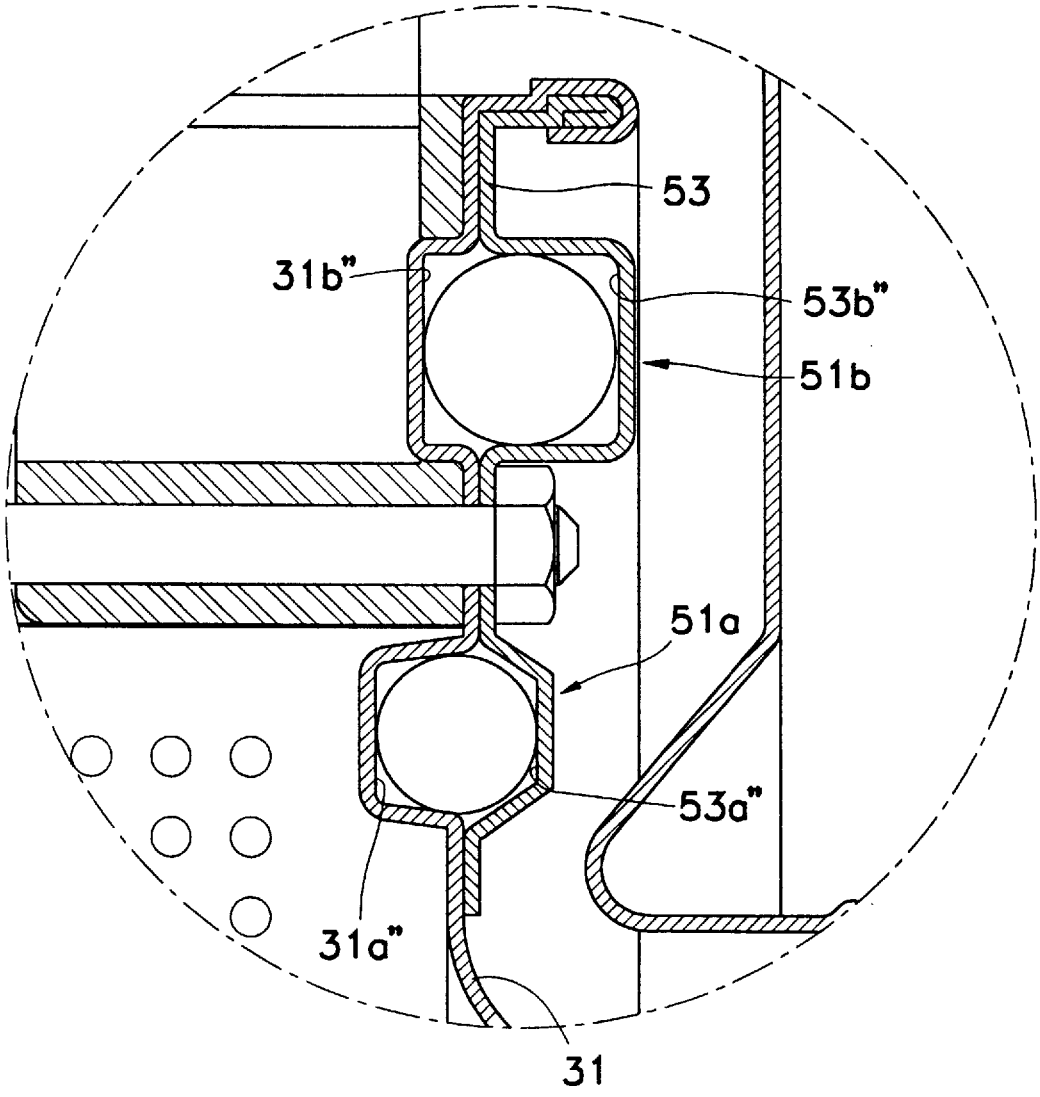
FIG. 4 is an enlarged view of a part of a balancing device for a drum washing machine in accordance with a third preferred embodiment of the present invention.
Figure 5:
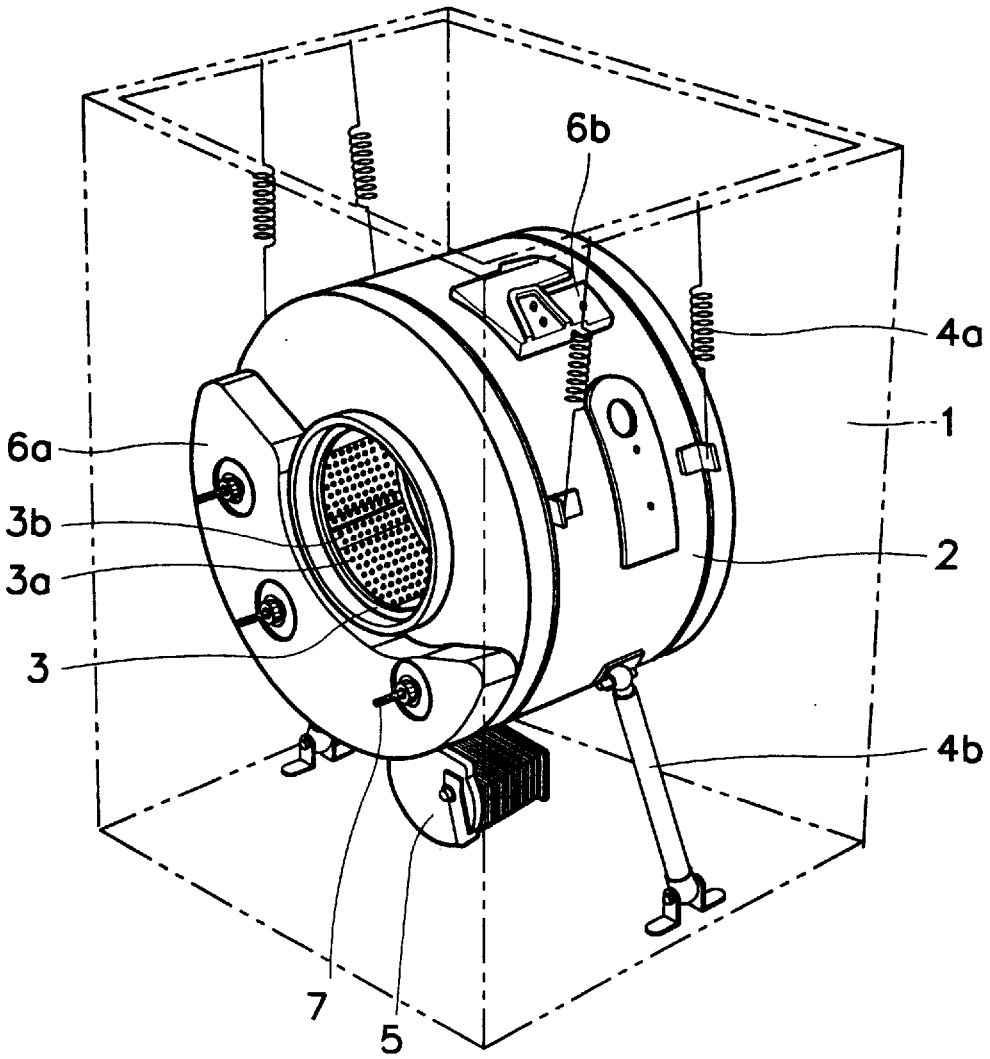
FIG. 5 (PRIOR ART)
FIG. 5 is a perspective view of the overall construction of a conventional drum washing machine.

FIG. 4 is an enlarged view of a part of a balancing device for a drum washing machine in accordance with the third preferred embodiment of the present invention. This embodiment is an improvement of the second preferred embodiment, and solves the problem that it is difficult to injection-mold the races if they are formed entirely of either an inward groove or an outward groove.

Most of the outer race 251*b* of FIG. 4 is formed by an outward groove 253*b*", formed on the plate member 253, and the rest of it is formed by an inward groove 231*b*" on the front panel 231. Most of the inner race 251*a* is formed by an inward groove 231*a*", formed on the front panel, and the rest of it is formed by an outward groove 253*a*" on the plate member. Forming the races 251*a*,251*b* in this manner provides for an easier injection-molding process.

The washing process carried out by the drum washing machine of FIG. 2 will now be described.

When the drum washing machine starts to operate, the electric motor 40 operates according to a prescribed program, so that the spin basket 30 rotates. The cleaning of the clothes contained therein is carried out by the use of the suds generated by the rotation of the spin basket 30, and further created by the action of the lifters 33*b* formed on the side panel 33 of the spin basket 30. The laundry and water are agitated by the lifters 33*b* and the side panel 33. The water is then removed from the laundry by centrifugal force as the spin basket 30 rotates at high speeds, and drains into the tub 20 through the holes 33*a* formed in the side panel 33.

The vibrations that are created by the uneven distribution of laundry in the spin basket 30 can be reduced by the following procedure.

The laundry is located on the bottom of the spin basket 30 in the initial stage of the hydro-extracting process. As the spin basket 30 rotates at high speeds, the balls 52*a* and 52*b* are moved to the opposite side of the imbalance along the corresponding races 51*a* and 51*b* by the centrifugal force created according to the high-speed rotation of the spin basket 30, thus compensating for the out-of-balance condition of the spin basket 30 and preventing the vibrations and eccentric rotation of the spin basket 30.

More specifically, the spin basket 30 turns eccentrically with respect to its geometric center due to the laundry being gathered on one spot in the spin basket 30. The centrifugal force from the geometric center and that of its center of rotation simultaneously act on the balls 52*a* and 52*b*, seated in the races 51*a* and 51*b*, so that the balls 52*a* and 52*b* relocate to -a predetermined position to oppose the imbalance. The balls 52*a* and 52*b* turn about the geometric center of the spin basket 30, thus making the center of rotation of the spin basket 30 correspond to the geometric center. This counters the unbalanced state of the spin basket 30, and thereby eliminates the vibrations and noise.

The mutual compensation of the moment produced by the inventive balancing devices is now described.

In the balancing devices of the present invention, the longitudinally inward-protruding part of the front panel 31 is similar in size to the longitudinally outward-protruding part of the rear panel 32, so the moment created by the inward-protruding part negates the moment produced by the outward-protruding part. Accordingly, the present invention prevents the front and rear panels 31 and 32 from being deformed by the moment of the balancing devices, thus precluding abnormal vibrations of the spin basket 30.

As fully described above, the drum washing machine, equipped with the balancing device of the present invention, prevents the spin basket from abnormally rotating by dynamically counteracting imbalances that may occur by the uneven arrangement of laundry therein, and eliminates the vibrations and noise created during rotation. The inventive balancing device may also prevent unnecessary wear of the components used to support the rotation of the spin basket and abnormal noise created by friction.

The respective balancing devices are designed to be of the same volume and weight in order to offset the moment created by the inward-protruding part of the front panel by the moment produced by the outward-protruding part of the rear panel. Thus, the present invention prevents the deformation of the front and rear panels and the abnormal vibrations of the spin basket that may be created by the moment.

What is claimed is:

1. A drum washing machine comprising:

a rotatable spin basket having a cylindrical side panel defining a horizontal center axis, a front panel connected to a front end of the side panel, and a rear panel connected to a rear end of the side panel;

a front plate joined to a front surface of the front panel along a front interface, and a rear plate joined to a rear surface of the rear panel along a rear interface;

the front panel and front plate together forming a front race structure comprised of radially spaced annular races arranged coaxially with the center axis;

the rear panel and rear plate together forming a rear race structure comprised of radially spaced annular races arranged coaxially with the center axis;

each of the front and rear race structures having one portion thereof protruding longitudinally forwardly of the respective interface, and another portion thereof protruding longitudinally rearwardly of the respective interface; and balls movably disposed in each of the races.

2. The drum washing machine according to claim 1 wherein one race of each race structure protrudes entirely to one longitudinal side of the respective interface, and another race of that race structure protrudes entirely to an opposite longitudinal side of the respective interface.

3. The drum washing machine according to claim 2 wherein one of the races of each race structure is formed by a longitudinally protruding groove disposed in the respective panel and closed off by a flat portion of the respective plate; another race of that race structure formed by a longitudinally protruding groove disposed in the respective plate and closed off by a flat portion of the respective panel.

4. The drum washing machine according to claim 1 wherein every race protrudes both longitudinally forwardly and longitudinally rearwardly of its respective interface.

5. The drum washing machine according to claim 4 wherein one of the races of a respective race structure protrudes longitudinally forwardly of the respective interface by a greater distance than it protrudes longitudinally rearwardly thereof, and another race of the respective race structure protrudes longitudinally rearwardly of the respective interface by a greater distance than it protrudes longitudinally forwardly thereof.

6. The drum washing machine according to claim 4 wherein each of the races is formed by a longitudinal groove formed on its respective panel and a mating groove formed on its respective plate.

7. The drum washing machine according to claim 1 wherein a vertical plane defined by each interface is spaced longitudinally from geometric centers of the balls located in the respective race.

8. The drum washing machine according to claim 1 wherein the forwardly protruding portion of each race structure protrudes forwardly by the same distance as the rearwardly protruding portion of the other race structure.

* * * * *